US010629010B2

(12) United States Patent
Peterson et al.

(10) Patent No.: US 10,629,010 B2
(45) Date of Patent: Apr. 21, 2020

(54) IDENTIFICATION SYSTEM AND METHOD FOR REMOTE TRANSMITTER OPERATION

(71) Applicant: Gentex Corporation, Zeeland, MI (US)

(72) Inventors: John C. Peterson, Grandville, MI (US); Kelly S. Harrelson, Holland, MI (US); Chris H. Vuyst, Zeeland, MI (US); Steven L. Willard, II, Holland, MI (US)

(73) Assignee: GENTEX CORPORATION, Zeeland, MI (US)

( * ) Notice: Subject to any disclaimer, the term of this patent is extended or adjusted under 35 U.S.C. 154(b) by 0 days.

(21) Appl. No.: 15/998,797

(22) Filed: Aug. 16, 2018

(65) Prior Publication Data

US 2019/0057562 A1 Feb. 21, 2019

Related U.S. Application Data

(60) Provisional application No. 62/546,627, filed on Aug. 17, 2017.

(51) Int. Cl.
*G07C 9/00* (2020.01)

(52) U.S. Cl.
CPC ..... *G07C 9/00087* (2013.01); *G07C 9/00079* (2013.01); *G07C 9/00103* (2013.01); *G07C 9/00174* (2013.01); *G07C 9/00111* (2013.01); *G07C 2009/00928* (2013.01)

(58) Field of Classification Search
None
See application file for complete search history.

(56) References Cited

U.S. PATENT DOCUMENTS 6,271,745 B1 8/2001 Anzai et al.
8,798,852 B1 * 8/2014 Chen ..... G06F 21/44 701/29.6
2014/0309891 A1 * 10/2014 Ricci ..... H04W 4/21 701/48
2019/0057562 A1 * 2/2019 Peterson ..... B60K 35/00

FOREIGN PATENT DOCUMENTS

WO 2013064504 A1 5/2013

OTHER PUBLICATIONS

Search Report and Written Opinion of the International Searching Authority, International Application No. PCT/IB2018/056188, dated Nov. 8, 2018 (7 pages).

* cited by examiner

*Primary Examiner* — Carlos Garcia
(74) *Attorney, Agent, or Firm* — Price Heneveld LLP; Bradley D. Johnson

(57) ABSTRACT

A transmission unit for mounting in a vehicle is disclosed. The transmission unit comprises a transmitter circuit configured to transmit control signals for operating a plurality of remote electronic devices. The transmission unit further comprises a scanning device configured to capture scan data and a controller in communication with the scanning device. The controller is configured to receive the scan data and determine a first identity of a first occupant based on the scan data. The controller is further operable to access a first user profile based on the first identity. The first user profile may comprise a customized or restricted set of control signals, which may be sent by the transmission unit based on an input or gesture from the first user.

16 Claims, 4 Drawing Sheets

IDENTIFICATION SYSTEM AND METHOD FOR REMOTE TRANSMITTER OPERATION

CROSS-REFERENCE TO RELATED APPLICATION

This application claims priority to and the benefit under 35 U.S.C. § 119(e) of U.S. Provisional Patent Application No. 62/546,627 filed on Aug. 18, 2017, entitled "IDENTIFICATION SYSTEM AND METHOD FOR REMOTE TRANSMITTER OPERATION," the entire disclosure of which is hereby incorporated herein by reference.

FIELD OF THE INVENTION

The present disclosure relates generally to the field of vehicle electronics. The present disclosure relates more particularly to transceiver units typically incorporated in a vehicle for facilitating communication between the vehicle and a remote electronic system. The present disclosure relates more particularly still to a transceiver device comprising a scanning apparatus configured to identify an operator of a vehicle based on biometric data.

SUMMARY OF THE INVENTION

In one aspect, the disclosure provides for a transmission unit or transmitter unit for mounting in a vehicle. The transmission unit comprises a transmitter circuit configured to transmit control signals for operating a plurality of remote electronic devices. The transmission unit further comprises a scanning device configured to capture scan data and a controller in communication with the scanning device. The controller is configured to receive the scan data and determine a first identity of a first occupant based on the scan data. The controller is further operable to access a first user profile based on the first identity. The first user profile comprises a first control signal configured to control a first remote electronic device.

In another aspect, a remote transmitter system for a vehicle is disclosed. The system comprises a transmitter circuit configured to transmit control signals for operating a plurality of remote electronic devices. The system further comprises a scanning device configured to capture scan data and a controller in communication with the scanning device. The controller is configured to determine a first identity of a first user based on the scan data, and access a first group of control signals in response to the first identity. The controller is further configured to determine a second identity of a second user based on the scan data and access a second group of control signals in response to the second identity. The controller is further configured to selectively transmit with the transmitter circuit the first control signal in response to determining the first identity and the second control signal in response to determining the second identity.

In yet another aspect, a method for transmitting control signals from a remote transmitter system is disclosed. The method comprises receiving scan data from a scanning device and determining a first identity of a first user based on the scan data. The method further comprises accessing a first group of control signals in response to the first identity and assigning the first group of control signals to a plurality of inputs. One of the control signals of the first group is transmitted in response to receiving an input to the plurality of inputs.

Those skilled in the art will appreciate that the foregoing summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

These and other features, advantages, and objects of the present invention will be further understood and appreciated by those skilled in the art by reference to the following specification, claims, and appended drawings.

DETAILED DESCRIPTION

It is to be understood that the various accessories, devices, systems, and methods discussed herein may assume various orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
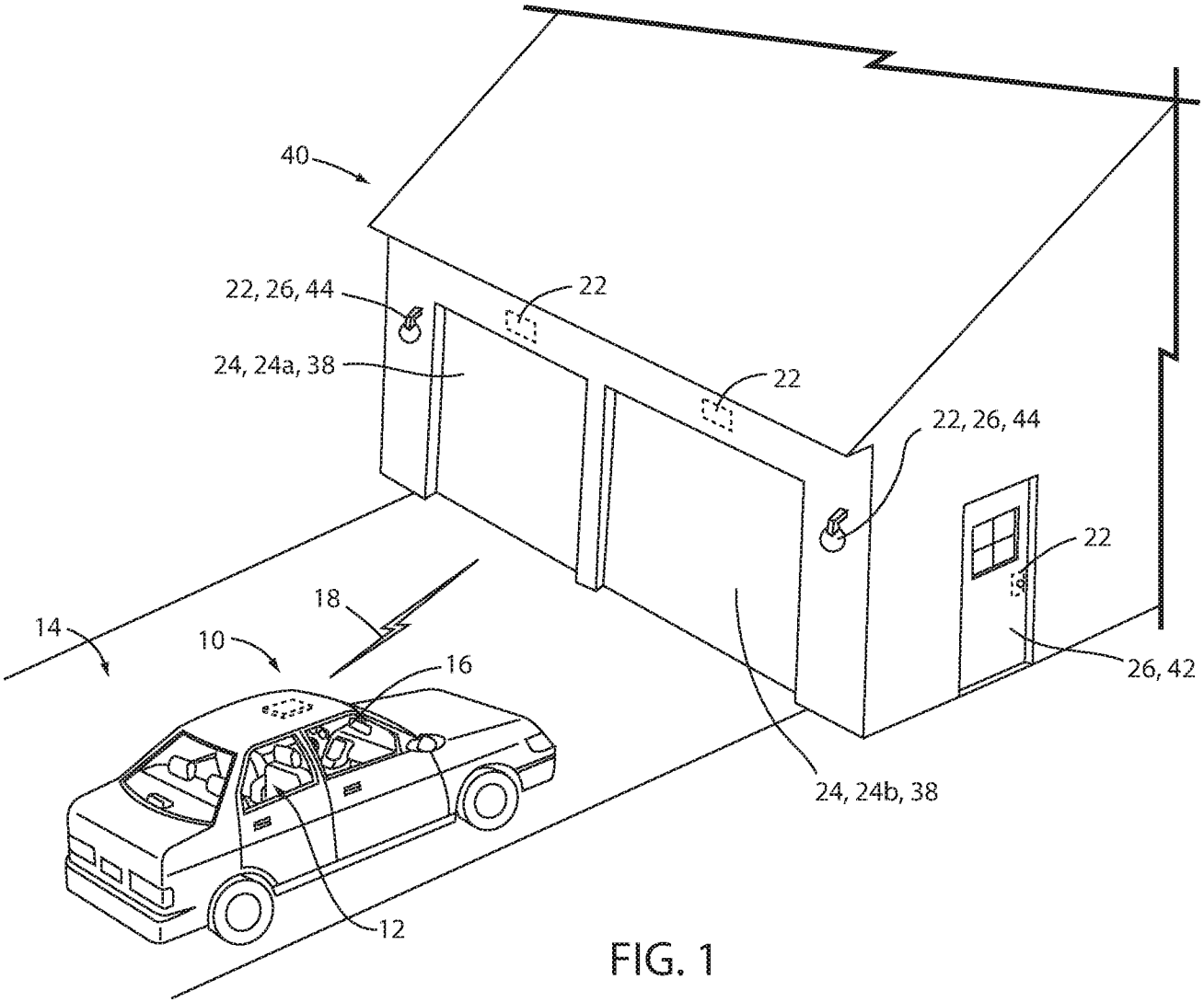
FIG. 1 is a drawing of a vehicle equipped with a remote transmitter unit configured to communicate with a remote electronic device, according to an exemplary embodiment.
Figure 2:
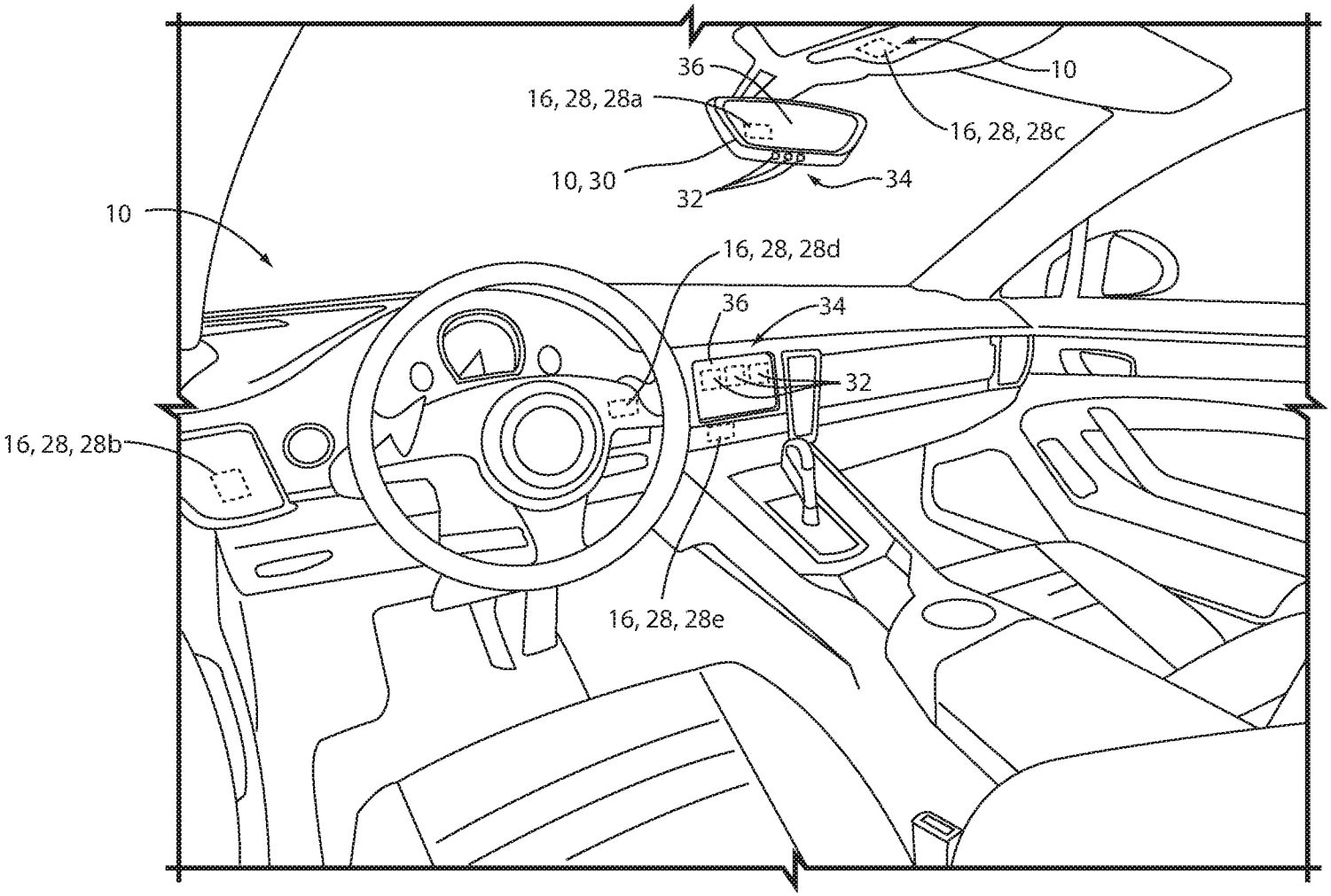
FIG. 2 is a perspective view of a passenger compartment of a vehicle comprising a remote transmitter unit comprising a scanning apparatus configured to capture biometric data to identify a user of the remote transmitter unit.

Referring to FIGS. 1 and 2, the disclosure provides for a remote transmitter unit 10 incorporated in a portion of or proximate to a passenger compartment 12 of a vehicle 14. In various embodiments, the remote transmitter unit 10 may be in communication with a scanning apparatus 16, which may be located in a variety of locations of the vehicle 14. The location of the scanning apparatus 16 may be readily accessible by an occupant of the vehicle 14. For clarity, an operator or passenger of the vehicle 14 will be referred to as occupants hereinafter. In combination with the scanning apparatus 16, the remote transmitter unit 10 may provide for user-specific or customized transmission signals 18 to be transmitted from the remote transmitter unit 10.

The transmission signals 18 may be determined by a controller of the remote transmitter unit 10 based on an identification profile or identification template for a user. The identification profiles for various users may be programmed in a memory or otherwise accessed by the controller based on a prior scan or identification training procedure. In general, the user profile may be identified by the controller by processing scan data captured by the scanning apparatus 16. Processing the scan data may include identifying patterns or characteristics of the scan data in comparison to a plurality of the identification profiles. Accordingly, based on the scan data, the controller may determine a user profile corresponding to the identification profile for each user of the transmitter unit 10. The user profile may comprise one or more user preferences comprising transmission data indicating one or more transmission protocols or security codes utilized by the remote transmitter unit 10 to activate at least one remote electronic device 22. The controller and the scanning apparatus 16 are discussed further in reference to FIG. 4.

For example, the controller of the transmitter unit 10 may be configured to receive the scan data from the scanning apparatus 16 in response to the scanning apparatus 16 detecting and scanning an identifying characteristic of an occupant. The identifying characteristic may correspond to a biological aspect of the occupant and may comprise an iris, fingerprint, palm-print, voice, face, gesture or any other biometric information that may be captured by the scanning apparatus 16. In some embodiments, the scan data may also correspond to a data transmission including an identification of the occupant. In such embodiments, the scan data may refer to a radio frequency identification transmitted from a radio frequency identification (RFID) module. In response to receiving the scan data of the occupant, the controller may identify a user profile of the occupant of the vehicle 14. Once the user profile is identified, the processor may continue to control one or more settings of the remote transmitter unit 10 based on the user profile. The one or more settings may include any form of vehicle setting and/or customization.

In some embodiments, the one or more settings of the user profile may include, but are not limited to, user specific activation signals or control signals configured to provide for remote access of a location, building, or home by controlling the remote operation of the at least one remote electronic device 22. In response to identifying the user profile, the controller may access at least one remote control signal or a first group of remote control signals from a memory. The control signal accessed by the controller may be based on a pre-authorized security setting indicating that the specific occupant identified from the user profile is authorized to utilize the at least one remote control signal or the first group of remote control signals. Accordingly, the remote transmitter unit may be operable to control the access of each of a plurality of occupants of the vehicle 14 to control only specifically designated remote electronic devices based on the user profile, which may be set up during a training operation of the user profiles.

In some embodiments, the remote transmitter unit 10 may correspond to a trainable transceiver unit. The trainable transceiver unit may be configured to "learn" the characteristics of multiple remote control signals generated by multiple remote control devices (e.g., a remote control for a garage door, a security gate, a home lighting system, a home security system, etc.) and store an indication of the multiple remote control signals in the memory thereof for subsequent retransmission. The trainable transceiver unit may reproduce a stored control signal upon receiving a user input (e.g., via a push button, a voice command, etc.) and transmit the stored control signal for operating the remote electronic device 22. Accordingly, the controller of the remote transmitter unit 10 may access one or more of the authorized activation signals from a plurality of remote control signals stored in the memory. In this way, each occupant may only be able to access and control the transmission of remote control assigned to a user profile of the occupant.

The remote transmitter unit 10 may be configured to communicate with a plurality of remote electronic devices 22 configured to control various remote operated barriers 24 (e.g., a first barrier 24*a* and a second barrier 24*b*) or other connected electronic accessories 26. In some embodiments, the remote operated barriers 24 may correspond to garage doors 38 attached to a garage 40 or various access gates, etc. The electronic accessories 26 may correspond to a range of accessories, including, but not limited to, access doors 42, security lights 44, remote lighting fixtures or appliances, a home security system, etc. The remote transmitter unit 10 may be configured to wirelessly communicate with the remote electronic devices 22 via the one or more communication circuits.

The one or more communication circuits of the remote transmitter unit 10 may communicate with the remote electronic devices 22 via wireless signals. The wireless signals may correspond to radio frequency (RF) signals, for example ultra-high frequency (UHF) band signals, and may also correspond to infrared signals, and/or various other wireless signals. The wireless signals of the remote transmitter unit 10 may be emitted and received via an antenna to communicate with remote electronic devices 22. In some embodiments, the wireless signals may further be communicated via one or more transmitter/receiver types to send and receive data and/or audiovisual content. Wireless technologies enabling such operation may include mobile radio networks and/or wireless broadcast networks, including, but not limited to, GSM, CDMA, WCDMA, GPRS, MBMS, Wi-Fi, WiMax, DVB-H, ISDB-T, etc., as well as advanced versions of these standards that may be developed at a later time. Further details regarding the communication circuits are discussed in reference to FIG. 4.

A user interface 34 of the trainable transmitter unit 10 and the scanning apparatus 16 may be integrated within a vehicle system component 28, such as a rearview mirror 28*a*, an instrument panel 28*b*, a headliner 28*c*, a steering wheel 28*d*, a center console stack 28*e*, or other locations within the vehicle 14. In some embodiments, the remote transmitter unit 10 may be integrated with a rearview mirror assembly 30 of the rearview mirror 28*a*. The remote transmitter unit 10 may include one or more user inputs 32 for controlling the collection and retransmission of a remote control signal. The one or more user inputs 32 may form a portion of or be separate from the scanning apparatus 16. For example, in some embodiments, the user inputs 32 may correspond to one or more electrical or electromechanical switches integrated in a user interface 34 of the remote transmitter unit 10. In some embodiments, the user interface 34 may be separately incorporated in the rearview mirror assembly 30 or in other portions of the vehicle 14 (e.g., the instrument panel 28*b*, a headliner 28*c*, a steering wheel 28*d*, a center console stack 28*e*, etc.). For clarity, the user inputs 32 may be referred to as a first user input 32*a*, a second user input 32*b*, a third user input 32*c*, etc.

In some embodiments, the controller of the remote transmitter unit 10 may also be configured to control a display of a prompt and receive a security code configured to identify the occupant of the vehicle 14. For example, each occupant may set a security code, which may be utilized similar to or as a redundancy to the scan data. In response to receiving the security code, the controller of the remote transmitter unit 10 may access the one or more remote control signals or a first group of remote control signals associated with the security code and the occupant from the memory. Accordingly, the remote transmitter unit 10 may be operable to control the access of each of a plurality of occupants of the vehicle 14 via the security code to control only specifically designated remote electronic devices based on the user profile. The security code may correspond to a numeric, alphanumeric, or any form of code that may be received from an occupant of the vehicle 14.

In some embodiments, the remote transmitter unit 10 may further comprise an electronic display 36 for presenting information. For example, a LED or other electronic displays may be positioned behind a reflective surface of the rearview mirror assembly 30 and used to present information (e.g., user profile identification, user preferences, a status of the remote electronic system, etc.) to a vehicle occupant through the reflective surface. The electronic display 36 may also be incorporated as part of an information display, navigation system, and/or entertainment system of the vehicle 14 as shown in FIG. 2 incorporated in the center console stack 28*e*. Accordingly, the remote transmitter unit 10 may be implemented in various ways to suit a variety of applications.

Figure 3:
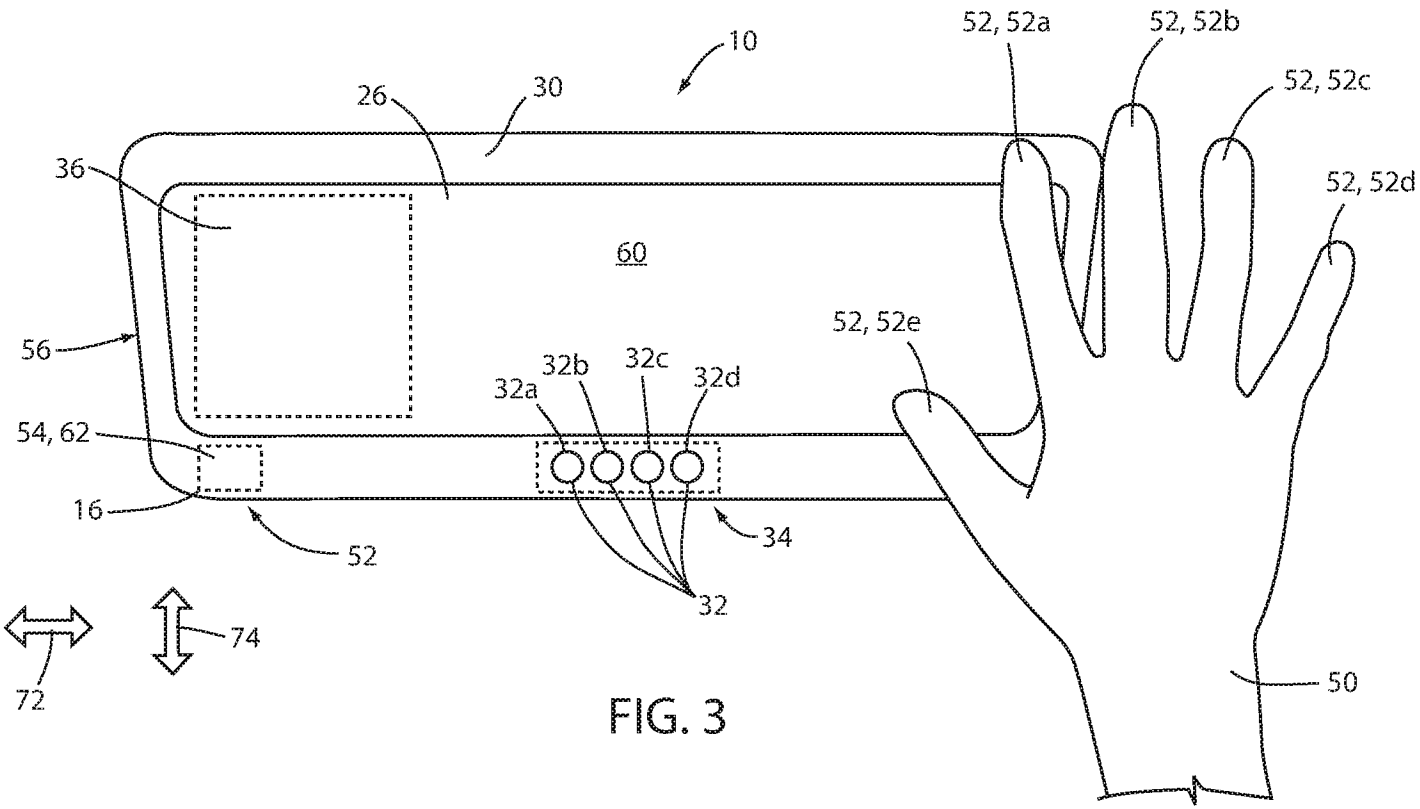
FIG. 3 is a pictorial diagram of a scanning apparatus incorporated in an interior rearview mirror configured to capture biometric data to identify a user of the remote transmitter unit.

Referring now to FIG. 3, a pictorial diagram of the scanning apparatus 16 incorporated in the rearview mirror assembly 30 is shown. The scanning apparatus 16 may be configured to capture biometric data to identify a user of the remote transmitter unit 10. The rearview mirror assembly 30 may comprise the display 36, which may be utilized by the remote transmitter unit 10 to display one or more instructions for completing an identification of the user profile for the occupant of the vehicle 14. In operation, the scanning apparatus 16 may be configured to identify a proximity detection of a portion (e.g., a hand 50 or a finger 52) of an occupant proximate to an outer protective surface 54 of the scanning apparatus 16. In response to the proximity detection, the controller of the remote transmitter unit 10 may activate a scanning operation of the scanning apparatus 16 to capture the scan data.

Based on the scan data, the controller may determine the identity of an occupant of the vehicle 14 by processing the scan data with one or more processing techniques and/or recognition algorithms. The processing techniques may comprise various pre-processing, filtering, and extraction techniques configured to enhance the quality or improve the processing accuracy of the recognition algorithms. Once the data is filtered and/or pre-processed, the controller may continue to process the scan data based on one or more identification algorithms. Such algorithms may compare the scan data to an identification template for each occupant of the vehicle 14. For example, the identification algorithm may apply a pattern-recognition analysis to the scan data in order to identify characteristics of the scan data that correspond to the identification template. If sufficient points or portions of the scan data match the identification template for a specific occupant (e.g., occupant 1), the controller may determine the identity of the occupant of the vehicle 14.

The scanning apparatus 16 may be implemented by one or more of a variety of devices configured to capture the biometric data of the passenger or the operator of the vehicle 14. The scanning apparatus 16 may correspond to an optical sensor, acoustic sensor, capacitive sensor, RF sensor, thermal sensor, piezoresistive sensor, ultrasonic sensor, piezoelectric sensor, etc. The scanning apparatus 16 may be configured to capture one or more identifiable features in the form of biometric information in the scan data. The biometric information may correspond to a variety of forms of data including, but not limited to, image data, audio data, capacitive or resistive maps, and/or various forms of sensory data. Such data may be utilized by the controller of the remote transmitter unit 10 to process an iris recognition, fingerprint recognition, voice recognition, face recognition, gesture recognition or various forms of biometric processing that may be captured by the scanning apparatus 16. Accordingly, the remote transmitter unit 10 may be configured to identify an occupant or portion of an occupant, such as the hand 50 or the finger 52 in a variety of ways to suit a desired application.

In some embodiments, the scanning apparatus 16 may be incorporated in a bezel portion 56 of the mirror assembly 30. For example, the scanning apparatus 16 may correspond to a capacitive sensor disposed behind the outer protective surface 54 (e.g., glass layer, sapphire layer, etc.). The capacitive sensor may be in communication with the controller via a circuit board (e.g., a printed circuit board) disposed behind a reflective surface element 60 of the mirror assembly 30. In this configuration, the scanning apparatus 16 may be incorporated in a portion of the mirror assembly 30 such that a recognition surface 62 of the scanning apparatus 16 is readily accessible to the passenger or the operator of the vehicle 14.

Referring now to FIGS. 1 and 3, based on the identity of the occupant of the vehicle 14, the remote transmitter unit 10 may access one or more of the activation signals for the user profile corresponding to the specific occupant based on the multiple remote control signals stored in the memory. For example, once the identity of the passenger is determined, the controller may load a preset selection of the remote control signals from the memory. For example, in response to an identification of occupant 1 based on the scan data, the controller may load a first user profile associated with occupant 1 including a first group of remote control signals to which occupant 1 is granted access. The first group of remote control signals may comprise specific transmission data configured to access the first barrier 24*a*, the second barrier 24*b*, the access door 42, and the security lights 44.

Based on an identification of a second occupant (e.g., occupant 2), the controller may load a second user profile. That is, in response to the scan data, the controller may load a second group of remote control signals that may be associated with or accessible by occupant 2. The second group of remote control signals may comprise specific transmission data configured to access the access door 42 and the security lights 44. However, the second group of remote control signals may be restricted and limit or prevent access to the remote control signals for the first barrier 24*a* and the second barrier 24*b*. Accordingly, the controller of the remote transmitter unit 10 may be configured to limit or prevent access to and/or control of one or more of the remote electronic devices 22 based on the user profile identified by the scanning apparatus 16.

Though the remote electronic devices 22 discussed herein are associated with a the domestic residence illustrated in FIG. 1, the remote transmitter unit 10 may similarly be operable to control remote electronic devices 22 associated with more than one residence (e.g., a primary dwelling and a cottage), as well as a variety of commercial properties, security gates, parking structures, and other various forms of barriers 24 and electronic accessories 26 that may be associated with a number of different in commercial settings, residential settings, industrial settings (e.g., service doors), etc. Accordingly, the remote transmitter unit 10 may provide for secure access to one or more areas or remote electronic devices 22 for at least one occupant of the vehicle 14 while restricting access to other occupants of the vehicle 14.

Referring again to FIGS. 1 and 3, in some embodiments, the controller may further be operable to activate a specific control signal of the multiple remote control signals stored in the memory. For example, the controller may be configured to identify a plurality of distinct inputs for the first user based on the scan data. The distinct inputs may be associated with the first user profile and correspond to scan data for different portions or identifying features of the first user. The different portions may correspond to different body parts or portions of the body, such as fingers or other identifiable portions. The distinct inputs may also correspond to gestures or voice commands, which may be biometrically linked by the controller to the first user by one or more identifying algorithms. As such, the distinct inputs may differ from the first user to a second user, third user, etc. In response to receiving such inputs via the scan data, the controller may control the transmitter unit 10 to transmit a corresponding signal for each of the distinct inputs. In this way, the controller may be configured to transmit different control signals in response to each of the distinct inputs received from a plurality of users.

In some embodiments, the controller may further be operable to detect a specific finger of an operator of the vehicle 14. For example, the controller may be configured to determine the identity of occupant 1 based on scan data for each of a first finger 52*a*, a second finger 52*b*, a third finger, 52*c*, a fourth finger 52*d*, and a fifth finger 52*e*. In response to the identification of the first finger 52*a*, the controller may access and transmit the first remote control signal to control the first barrier 24*a*. In response to the identification of the second finger 52*b*, the controller may access and transmit the second remote control signal to control the second barrier 24*b*. In this configuration, the controller may be configured to activate the operation of one or more of the remote electronic devices 22 based on recognition of each of the specific fingers 52 of the operator.

In some embodiments, the controller of the remote transmitter unit 10 may be configured to identify and transmit a different remote control signal in response to each of the fingers 52. As previously discussed, the controller may control a transmission of a first control signal in response to the scan data representing the first finger 52*a* and control a transmission of a second control signal in response to the scan data representing the second finger 52*b*. Additionally, the controller may be operable to identify the third finger 52*c*, the fourth finger 52*d*, and the fifth finger 52*e* of the first occupant (occupant 1). In response to the identification, the controller may control a transmission of a third control signal, a fourth control signal, and a fifth control signal, respectively. In this configuration, the remote transmitter unit 10 may be configured to control specific remote electronic devices 22 based on an identification of each finger 52. Accordingly, the remote transmitter unit 10 may provide for secure control of a variety of devices that may only be accessed in response to the scan data identifying a specific finger of a specific occupant of the vehicle 14.

Referring still to FIGS. 1 and 3, in some embodiments, the scanning apparatus 16 of the remote transmitter unit 10 may be configured to detect or identify a motion or gesture of the portion of the occupant proximate the recognition surface 62. As previously discussed, the scanning apparatus 16 may be configured to identify one or more directional motions or gestures of the hand 50 or the finger 52. For example, in some embodiments, the controller may be configured to detect a left or right directional motion of the hand 50 or fingers 52 as demonstrated by left/right arrows 72. Additionally, the controller may be configured to detect an up or down motion of the hand 50 or fingers 52 as demonstrated by up/down arrows 74. In operation, the controller may identify the movement based on a corresponding motion identified in the scan data captured by the scanning apparatus 16. Accordingly, the scanning apparatus 16 may be configured to update a capture of the scan data in order to identify changes in the scan data over time. Accordingly, in various embodiments, the controller may be operable to identify the left, right, up, and/or down motion based on the scan data.

In response to the left, right, up, and/or down motion identified from the scan data, the controller may activate one or more functions of the remote electronic devices 22. For example, some of the remote electronic devices may be configured to receive a plurality of control signals configured to control different functions. In embodiments, wherein the barrier 24 comprises a garage door, the associated remote electronic device 22 configured to control the garage door may be configured to receive an open instruction and separate close instruction in the form of directionally specific coded radio transmissions. Such signals may be accessed by the controller as one or more of the remote control signals stored in the memory. Accordingly, in response to identifying an upward motion of the hand 50 or finger 52 proximate the scanning apparatus 16, the controller may control the transmission of a control signal configured to open the first barrier 24*a*. Additionally, in response to identifying a downward motion proximate the scanning apparatus 16 the controller may control the transmission of a control signal configured to close the second barrier 24*b*.

Figure 4:
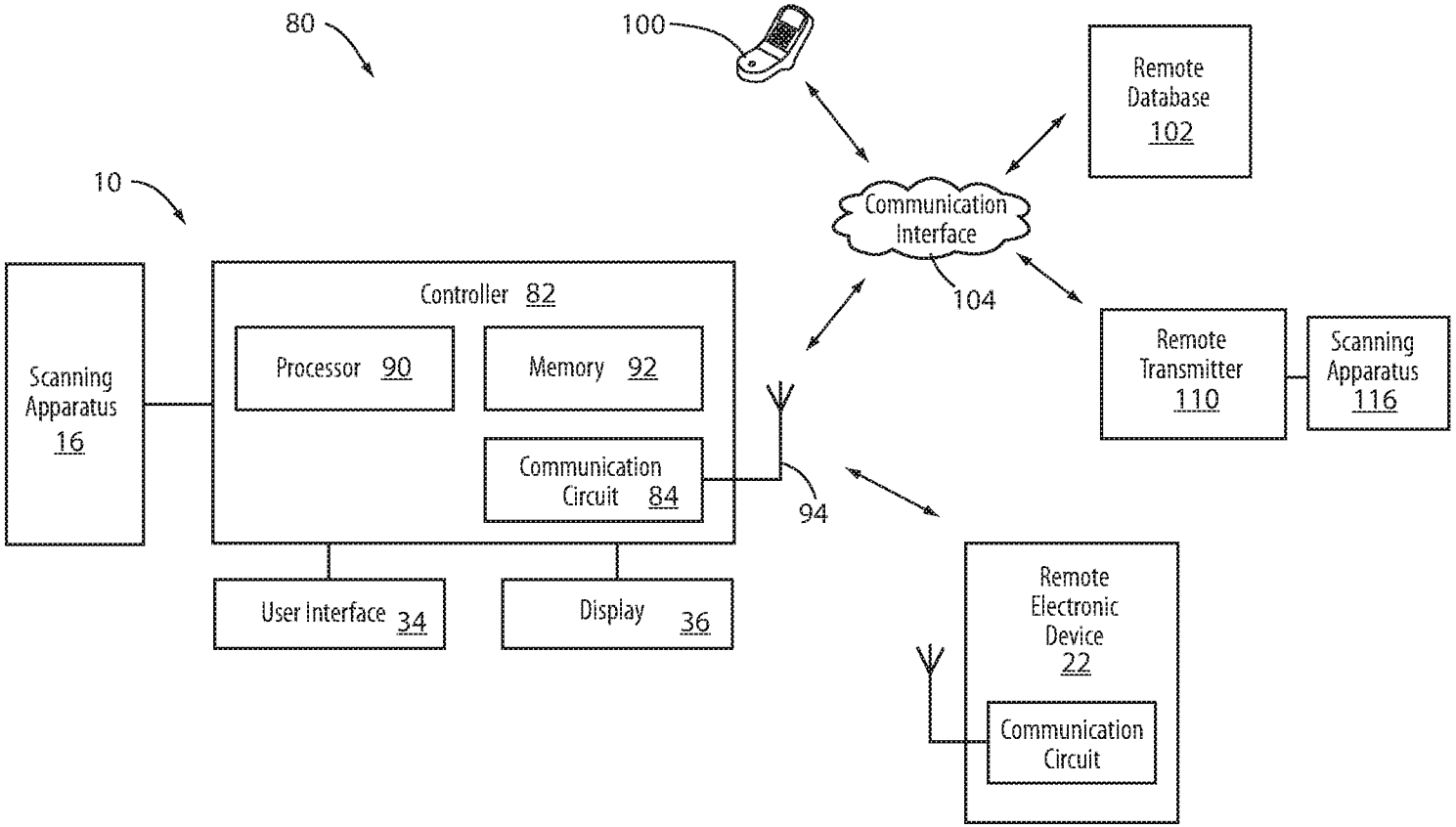
FIG. 4 is a block diagram of a remote transmitter unit shown to include a scanning apparatus configured to capture biometric data to identify a user of the remote transmitter unit in accordance with the disclosure.

Referring now to FIG. 4, a block diagram of a system 80 comprising the remote transmitter unit 10 and a remote electronic device 22 is shown, according to an exemplary embodiment. In brief overview, remote transmitter unit 10 is shown to include the scanning apparatus 16, the user interface 34, a display 36, a controller 82, and a communication circuit 84. The communication circuit 84 may correspond to a transmitter or transceiver configured to communicate the control signals as discussed herein. In some embodiments, the communication circuit 84 may comprise a plurality of communication circuits configured to communicate the remote electronic devices 22 and one or more mobile devices (e.g., cell phones, smart phones, tablets, computers, etc.) or remote servers (e.g., cloud servers, internet connected databases, computers, etc.).

The scanning apparatus 16 may be implemented by one or more of a variety of devices configured to capture the biometric data of the occupant (e.g., the passenger or the operator) of the vehicle 14. The scanning apparatus 16 may correspond to an optical sensor, acoustic sensor, capacitive sensor, RF sensor, thermal sensor, piezoresistive sensor, ultrasonic sensor, piezoelectric sensor, etc. The scanning apparatus 16 may be configured to capture one or more identifiable features in the form of biometric information in the scan data. The biometric information may correspond to a variety of forms of data including, but not limited to, image data, audio data, capacitive or resistive maps, and/or various forms of sensory data. Such data may be utilized by the controller of the remote transmitter unit 10 to process an iris recognition, fingerprint recognition, voice recognition, face recognition, gesture recognition or various forms of biometric processing that may be captured by the scanning apparatus 16. Accordingly, the remote transmitter unit 10 may be configured to identity an occupant or portion of an occupant, such as the hand 50 or the finger 52, in a variety of ways to suit a desired application.

In some embodiments, the scanning apparatus 16 may be operable to identify an occupant based on a security code or radio frequency identification. The security code may be scanned as an encrypted or coded symbol (e.g., a barcode, QR code, etc.) and may also be entered via the user interface 34. In embodiments wherein the scanning device 16 is configured to receive the radio frequency identification of the occupant, the scanning device 16 may comprise an RFID module. The RFID module of the scanning apparatus may comprise a passive reader active tag (PRAT) system, an active reader passive tag (ARPT) system, and/or an active reader active tag (ARAT) system. Similarly, the radio frequency identification may be communicated via a near-field communication (NFC) communication protocol or similar wireless communication protocol.

The user interface 34 may facilitate communication between the occupant and the remote transmitter unit 10. For example, the user interface 34 may comprise a plurality of user inputs 32, each configured to communicate a selection to the controller 82 of the remote transmitter unit 10. Based on the user profile identified and activated by the controller 82 in response to the scan data, the controller may assign a specific control signal to each of the user inputs 32. Accordingly, the user interface 34 may provide for a means of access for the occupant associated with the user profile to instruct the controller 82 to activate specific remote electronic devices 22 associated with each of the user inputs 32 via the user profile.

In some embodiments, user inputs 32 may include one or more push buttons, switches, dials, knobs, touch-sensitive user input devices (e.g., piezoelectric sensors, capacitive touch sensors, etc.), or other devices for translating a tactile input into an electronic data signal. In some embodiments, input devices may also or alternatively include an optical sensor, a microphone, a voice-actuated input control circuit configured to receive voice signals from a vehicle occupant, or other user input interfaces configured to receive other forms of user input. Advantageously, user inputs 32 may be integrated with a rearview mirror assembly 30. For example, user inputs 32 may include one or more pushbuttons (e.g., mounted along a lower surface of a rearview mirror assembly) as shown in FIG. 3.

The display 36 may include one or more electronic display devices 36 for presenting visual information to the vehicle 14. In some embodiments, the display 36 may be a light-emitting diode (LED) panel, an organic (LED) panel, a liquid crystal display (LCD) panel, a backlit display, or other type of electronic display device. In some embodiments, display 36 is integrated with the rearview mirror assembly 30. For example, the display 36 may be located between a front reflective surface element 60 (e.g., the mirror) and a back housing of the mirror assembly 30. In this configuration, the display 36 may be configured to emit light through the front reflective surface element 60 of the rearview mirror assembly 30.

The controller 82 may comprise a processor 90 and memory 92. The processor 90 may be implemented as a general purpose processor, a microprocessor, a microcontroller, an application specific integrated circuit (ASIC), one or more field programmable gate arrays (FPGAs), a CPU, a GPU, a group of processing components, or other suitable electronic processing components. The memory 92 may include one or more devices (e.g., RAM, ROM, Flash® memory, hard disk storage, etc.) for storing data and/or computer code for completing and/or facilitating the various processes, layers, and modules described in the present disclosure. The memory 92 may comprise volatile memory or non-volatile memory and may include database components, object code components, script components, or any other type of information structure for supporting the various activities and information structures described in the present disclosure. In some implementations, memory 92 is communicably connected to processor 90 and includes computer code (e.g., data modules stored in memory 92) for executing one or more control processes described herein.

The communication circuit 84 may comprise one or more antennas 94 configured to transmit wireless control signals having control data which will control the remote electronic devices 22. The communication circuit 84 may be configured, under control from the controller 82, to generate a carrier frequency at any of a number of frequencies in the ultra-high frequency range, typically between 260 and 960 megahertz (MHz) although other frequencies could be used, wherein the control data modulated on to the carrier frequency signal may be frequency shift key (FSK) or amplitude shift key (ASK) modulated, or may use another modulation technique. In the example of the remote electronic device 22 being the garage door 38, the control data on the wireless control signal may, for example, be a fixed code or a rolling code or other cryptographically encoded control code suitable for use with the remote electronic device 22.

In some embodiments, the communication circuit 84 may further be configured to communicate with the one or more mobile devices 100 (e.g., cell phones, smart phones, tablets, computers, etc.) or remote servers 102 (e.g., cloud servers, internet connected databases, computers, etc.) via a communication interface 104. The mobile devices 100 and/or the remote server 102 may be configured to store the wireless control signals associated with one or more occupants of the vehicle 14. For example, the controller 82 may communicate and store each set of the remote control signals from the memory 92 on the mobile device 100 or the remote server 102 via the communication circuit 84. Additionally, the controller 82 may communicate and store the identification template for each occupant of the vehicle 14 on the mobile device 100 or the remote server 102.

Once the identification template and the remote control signals are stored on the mobile device 100 or the remote server 102, an occupant may utilize an additional remote transmitter unit 110 to access the remote control signals such that the additional remote transmitter unit may retrieve the remote control signals via the communication circuit 84 and store the remote control signals in memory. The additional remote transmitter unit 110 may have the same functionality as described in reference to the remote transmitter unit 10, but is referred to as the additional remote transmitter 110 (e.g., a second remote transmitter unit) for clarity. Accordingly, the additional remote transmitter 110 may be incorporated in a different vehicle. In this way, the system 80 may provide for secure access of the remote control signals in any vehicle equipped with the remote transmitter unit 10, 110, etc.

For example, the controller 82 of the remote transmitter unit 10 may communicate the first user profile comprising the first group of remote control signals to which occupant 1 is granted access to the mobile device 100 or remote server 102 via the communication interface 104. Additionally, the controller 82 may communicate a first identification template or security code associated with the scan data for occupant 1 to the mobile device 100 or remote server 102. Occupant 1 may later utilize the additional remote transmitter 110. The additional remote transmitter unit 110 may comprise a scanning apparatus 116 similar to the scanning apparatus 16. The controller of the additional remote transmitter unit 110 may process scan data from the scanning apparatus 116 and transmit the scan data to the mobile device 100 or remote server 102. Additionally, the additional remote server may receive the security code via the user interface 34. The mobile device 100 or remote server 102 may then compare the scan data or the security code to a plurality of identification templates or codes stored in a memory of the mobile device 100 or remote server 102.

Upon identifying that the security code or the scan data matches the first identification template, the mobile device 100 or remote server 102 may transmit the first profile comprising the first group of control signals and the first identification template to the additional remote transmitter unit 110 via the communication interface 104. Once the first profile is loaded to the memory of the additional remote transmitter unit 110, occupant 1 may utilize the additional remote transmitter unit 110 to access and transmit the remote control signals associated with the first profile in the same way described in reference to the remote transmitter unit 10. Accordingly, the remote transmitter units 10, 110 of the system 80 may be in communication via the communication interface 104 such that the functionality of the remote transmitter unit 10 may be conveniently and securely shared among a plurality of remote transmitter units (e.g., a first remote transmitter unit, a second remote transmitter unit, a third remote transmitter unit, etc.).

The communication interface 104 may correspond to a variety of communication protocols configured to distribute data among various electronic devices. For example, the communication interface 104 may comprise an IEEE 802.11 connection, and IEEE 802.15 connection, a Bluetooth® connection, a Wi-Fi connection, a WiMAX connection, cellular signal, a signal using Shared Wireless Access Protocol-Cord Access (SWAP-CA) protocol, or any other type of RF or wireless signal. An IEEE 802.15 connection includes any wireless personal area networks (WPAN), such as ZigBee, Z-Wave, Bluetooth, UWB, and IrDA. In this configuration, the communication interface 104 may provide for data communication between the controller 82 and the mobile device 100 or the remote server 102 such that the control signals stored on the mobile device 100 or the remote server may be transferred in response to identifying the occupant of the vehicle 14.

In some embodiments, the communication interface 12 may further be configured to communicate with a mobile device 20. The mobile device 20 may be in communication directly with the wireless router 18, directly with one or more of the appliances 14 or the utilities 16, and may be operable to communicate with the wireless router 18 via a broadband or wireless network. Hereinafter the broadband or wireless network may be described as an external network 22, which may correspond to a cloud based network system or network with internet connectivity. Via the external network 22, the mobile device 20 may further be in communication with one or more external servers 24. Accordingly, the disclosure may provide for a remotely activated home control system 26 commonly referred to as a smart home system.

It should be noted that references to "front," "back," "rear," "upward," "downward," "inner," "outer," "right," and "left" in this description are merely used to identify the various elements as they are oriented in FIG. 2. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor 90. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also, two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

The invention claimed is:

1. A transmission unit for mounting in a rearview mirror of a vehicle, the transmission unit comprising:
a transmitter circuit configured to transmit control signals for operating a plurality of remote electronic devices;
a scanning device configured to capture scan data; and
a controller in communication with the scanning device, wherein the controller is configured to:
receive the scan data;
determine a first identity of a first user based on the scan data;
identify a first finger and a second finger of the first user based on the scan data;
access a first user profile based on the first identity, wherein the first user profile comprises a first control signal and a second control signal configured to control a first remote electronic device and second remote electronic device, respectively;
in response to receiving the scan data of the first finger, transmit the first control signal with the transmitter circuit to control the first remote electronic device; and
in response to receiving the scan data of the second finger, transmit the second control signal with the transmitter circuit to control the second remote electronic device.

2. The transmission unit according to claim 1, wherein the first user profile further comprises a third control signal configured to control a third remote electronic device; and wherein the controller is further configured to:
identify a third finger of the first user based on the scan data; and
in response to receiving the scan data of the third finger, transmit the third control signal with the transmitter circuit.

3. The transmission unit according to claim 1, wherein the controller is further configured to:
determine a second identity of a second user based on the scan data;
access a second user profile based on the second identity, wherein the second user profile comprises a third control signal configured to control a third remote electronic device; and
in response to receiving the scan data of the second user, transmit the third control signal with the transmitter circuit.

4. The transmission unit according to claim 3, further comprising:
a user interface comprising a first user input and configured to communicate a first activation signal to the controller and a second user input configured to communicate a second activation signal to the controller.

5. The transmission unit according to claim 1, wherein the controller is further configured to:
identify a distinct input from the first user based on the scan data, wherein the distinct input comprises a distinct portion of the first user being scanned to identify the distinct input.

6. The transmission unit according to claim 5, wherein the first user profile comprises a plurality of first user control signals configured to control a plurality of remote electronic devices, and wherein the controller is further configured to:
in response to receiving the scan data of the distinct portion of the first user, transmit each of the first user control signals.

7. A remote transmitter system for a vehicle comprising:
a transmitter circuit configured to transmit control signals for operating a plurality of remote electronic devices;
a scanning device configured to capture scan data; and
a controller in communication with the scanning device, wherein the controller is configured to:
receive the scan data;
determine an identity of a user based on the scan data;
identify a first portion and a second portion of the user based on the scan data;
access a user profile based on the identity, wherein the user profile comprises a first control signal and a second control signal configured to control a first remote electronic device and second remote electronic device, respectively;
in response to receiving the scan data of the first portion, transmit the first control signal with the transmitter circuit to control the first remote electronic device; and
in response to receiving the scan data of the second portion, transmit the second control signal with the transmitter circuit to control the second electronic device.

8. The system according to claim 7, further comprising:
a user interface comprising a first user input and configured to communicate a first activation signal to the controller.

9. The system according to claim 7, wherein the user profile further comprises a third control signal configured to control a third remote electronic device.

10. The system according to claim 9, wherein the controller is further configured to:
identify a third portion of the user based on the scan data; and
in response to receiving the scan data of the third portion, transmit the third control signal.

11. The system according to claim 7, wherein the first portion and the second portion comprise at least one identifiable feature of the user in form of biometric information based on the scan data.

12. The system according to claim 11, wherein the third portion comprises at least one identifiable feature of the user in form of biometric information based on the scan data.

13. A method for transmitting control signals from a remote transmitter system comprises:
receiving scan data from a scanning device;
determining a first identity of a first user based on the scan data;
accessing a first group of control signals in response to the first identity; and
assigning the first group of control signals to a first and second finger of the first user, wherein one of the control signals of the first group is transmitted in response to receiving the scan data of the first finger, and another one of the control signals of the first group is transmitted in response to receiving scan the data of the second finger.

14. The method according to claim 13, further comprising:
determining a second identity of a second user based on the scan data;
accessing a second group of control signals in response to the second identity;
assigning the second group of control signals to a finger of the second user; and
transmitting one of the control signals of the second group in response to receiving the scan data of the finger of the second user.

15. The method according to claim 14, wherein the first group of control signals comprises at least one different control signal than the second group of control signals.

16. The method according to claim 14, wherein each of the control signals of the groups of control signals is configured to control at least one function of a remote electronic device.

* * * * *